US006617092B1

(12) United States Patent
Patel et al.

(10) Patent No.: US 6,617,092 B1
(45) Date of Patent: Sep. 9, 2003

(54) TONER PROCESSES

(75) Inventors: Raj D. Patel, Oakville (CA); Michael A. Hopper, Toronto (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/106,519

(22) Filed: Mar. 25, 2002

(51) Int. Cl.[7] ..... G03G 9/083

(52) U.S. Cl. ..... 430/137.14; 430/106.2

(58) Field of Search ..... 430/137.14, 106.2; 523/335

(56) References Cited

U.S. PATENT DOCUMENTS

| | | | | |
|---|---|---|---|---|
| 3,998,160 | A | 12/1976 | Pearce | 101/426 |
| 4,128,202 | A | 12/1978 | Buros | 235/493 |
| 4,517,268 | A | 5/1985 | Gruber et al. | 430/39 |
| 4,758,506 | A | 7/1988 | Lok et al. | 430/903 |
| 4,859,550 | A | 8/1989 | Gruber et al. | 430/39 |
| 5,034,298 | A | 7/1991 | Berkes et al. | 430/110 |
| 5,278,020 | A | 1/1994 | Grushkin et al. | 430/137 |
| 5,290,654 | A | 3/1994 | Sacripante et al. | 430/137 |
| 5,308,734 | A | 5/1994 | Sacripante et al. | 430/137 |
| 5,344,738 | A | 9/1994 | Kmiecik-Lawrynowicz et al. | 430/137 |
| 5,370,963 | A | 12/1994 | Patel et al. | 430/137 |
| 5,482,812 | A | 1/1996 | Hopper et al. | 430/137 |
| 5,510,221 | A | 4/1996 | Matalevich et al. | 430/106.6 |
| 5,622,806 | A | 4/1997 | Veregin et al. | 430/137 |
| 5,780,190 | A | 7/1998 | Listigovers et al. | 430/39 |
| 5,914,209 | A * | 6/1999 | Grushkin | 430/106.6 |
| 5,919,595 | A | 7/1999 | Mychajlowskij et al. | 430/137 |
| 5,922,501 | A | 7/1999 | Cheng et al. | 430/137 |
| 5,925,488 | A | 7/1999 | Patel et al. | 430/137 |
| 5,945,245 | A | 8/1999 | Mychajlowskij et al. | 430/137 |
| 5,977,210 | A | 11/1999 | Patel et al. | 523/161 |
| 5,994,020 | A | 11/1999 | Patel et al. | 430/137 |
| 6,132,924 | A | 10/2000 | Patel et al. | 430/137 |
| 6,268,102 | B1 | 7/2001 | Hopper et al. | 430/137.14 |

* cited by examiner

*Primary Examiner*—John Goodrow
(74) *Attorney, Agent, or Firm*—E. O. Palazzo

(57) ABSTRACT

An emulsion aggregation process for the preparation of a magnetite toner, and where the magnetite can function as a coagulant.

28 Claims, No Drawings

TONER PROCESSES

CROSS REFERENCE

Illustrated in copending application U.S. Ser. No. 10/106,473 on Toner Processes, filed concurrently herewith, the disclosure of which is totally incorporated herein by reference, is a toner process for the preparation of a toner comprising mixing a colorant dispersion comprising an acicular magnetite dispersion and a carbon black dispersion with a latex, a wax dispersion and a coagulant.

Illustrated in application U.S. Ser. No. 10/106,514, filed concurrently herewith, the disclosure of which Is totally incorporated herein by reference, is an emulsion aggregation process for the preparation of a magnetite toner and where the magnetite can function as a negatively charged coagulant to facilitate aggregation of a basic cationic latex, a cationic carbon black dispersion and a cationic wax dispersion.

Illustrated in copending application U.S. Ser. No. 10/106,512 on Toner Processes, filed concurrently herewith, the disclosure of which is totally incorporated herein by reference, is a process comprising heating an acidified dispersion of an acicular magnetite, a carbon black colorant dispersion, an optional wax dispersion, and an acicular latex.

Illustrated in copending application U.S. Ser. No. 10/086,063 on Toner Processes, the disclosure of which is totally incorporated herein by reference, is a process comprising heating a latex, a colorant dispersion, a polytetrafluoroethylene dispersion, and an organo metallic complexing component.

Illustrated in copending application U.S. Ser. No. 10/106,520 on Toner Coagulant Processes, the disclosure of which is totally incorporated herein by reference, is a process for the preparation of toner comprising (i) generating or providing a latex emulsion containing resin, water, and an ionic surfactant, and generating or providing a colorant dispersion containing colorant, water, and an ionic surfactant, or a nonionic surfactant;

(ii) blending the latex emulsion with the colorant dispersion;

(iii) adding to the resulting blend a coagulant of a polyamine salt of an acid wherein the salt is of an opposite charge polarity to that of the surfactant latex;

(iv) heating the resulting mixture below or about equal to the glass transition-temperature (Tg) of the latex resin;

(v) optionally adding a second latex comprised of resin particles suspended in an aqueous phase resulting in a shell;

(vi) adjusting with a base the pH to about 7 to about 9;

(vii) heating the resulting mixture of (vi) above about the Tg of the latex resin;

(viii) retaining the heating until the fusion or coalescence of resin and colorant is initiated;

(ix) changing the pH of the above (viii) mixture with an acid to arrive at a pH of about 1.5 to about 3.5 to thereby accelerate the fusion or the coalescence and resulting in toner particles comprised of resin, and colorant; and (x) optionally isolating the toner.

BACKGROUND

The present invention relates to toner processes, and more specifically, to aggregation and coalescence processes for the preparation of toner compositions containing magnetite. More specifically, the present invention in embodiments relates to processes for the preparation of a toner composition by a chemical process, such as emulsion aggregation, wherein latex particles are aggregated with colorant particles, such as magnetite or iron oxides, and wherein such particles can simultaneously function as colorant particles and as a coagulating or flocculating agent, and thereafter coalescing or fusing to provide toner size particles which when developed by an electrographic process generates documents suitable for magnetic image character recognition or MICR. The use of iron oxide particles, which can exhibit a positive of about +10 to about −40 coulombs per square centimeter (coulombs/$cm^2$) at low pH conditions, such as for example, from about 1.5 to about 5 and a charge of about −2 to about −40 coulombs/$cm^2$ at a high pH, such as for example about 6.5 to about 10, permits such particles to function as coagulating or flocculating agents for anionically charged species and catatonically charged species, respectively.

REFERENCES

In U.S. Pat. No. 6,132,924, the disclosure of which is totally incorporated herein by reference, there is illustrated a process for the preparation of toner comprising mixing a colorant a latex, and a coagulant, followed by aggregation and coalescence, wherein the coagulant may be a polyaluminum chloride.

In U.S. Pat. No. 6,268,102, the disclosure of which is totally incorporated herein by reference, there is illustrated a process for the preparation of toner comprising mixing a colorant, a latex, and a coagulant, followed by aggregation and coalescence wherein the coagulant may be a polyaluminum sulfosilicate.

Illustrated in U.S. Pat. No. 5,994,020, the disclosure of which is totally incorporated herein by reference, are toner preparation processes, and more specifically, a process for the preparation of toner comprising (i) preparing, or providing a colorant dispersion;

(ii) preparing, or providing a functionalized wax dispersion comprised of a functionalized wax contained in a dispersant mixture comprised of a nonionic surfactant, an ionic surfactant, or mixtures thereof;

(iii) shearing the resulting mixture of the functionalized wax dispersion (ii) and the colorant dispersion (i) with a latex or emulsion blend comprised of resin contained in a mixture of an anionic surfactant and a nonionic surfactant;

(iv) heating the resulting sheared blend of (iii) below about the glass transition temperature (Tg) of the resin particles;

(v) optionally adding additional anionic surfactant to the resulting aggregated suspension of (iv) to prevent, or minimize additional particle growth of the resulting electrostatically bound toner size aggregates during coalescence (iv);

(vi) heating the resulting mixture of (v) above about the Tg of the resin; and optionally, (vii) separating the toner particles.

With respect to the references, only a small part thereof has been selected and this part may or may not be fully representative of the prior art teachings or disclosures.

Magnetic ink printing methods with inks containing magnetic particles are known. For example, there is disclosed in U.S. Pat. No. 3,998,160 that various magnetic. inks have been used in printing digits, characters, or artistic designs, on checks or bank notes. The magnetic ink used for these processes contains, for example, acicular magnetic particles, such as magnetite in a fluid medium, and a magnetic coating of ferric oxide, chromium dioxide, or similar materials-dispersed in a vehicle of binders, and plasticizers. Disclosed in U.S. Pat. No. 4,128,202 is a device for transporting a document that has been mutilated or erroneously encoded, and wherein there is provided a predetermined area for the receipt of correctly encoded magnetic image character recognition information (MICR). As indicated in this patent, the information involved. is referred to as MICR characters, which characters appear, for example, at the bottom of personal checks as printed numbers and symbols. These checks can be printed in an ink containing magnetizable particles therein, and when the information contained on the document is to be read, the document is passed through a sorter/reader which first magnetizes the magnetizable particles, and subsequently detects a magnetic field of the symbols resulting from the magnetic retentivity of the ink. The characters and symbols involved, according to the '202 patent are generally segregated into three separate fields, the first field being termed a transient field, which contains the appropriate symbols and characters to identify the bank, bank branch, or the issuing source. The second field contains the account affected by the transactions, and the third field, which is not prerecorded, indicates the amount of the check.

In U.S. Pat. No. 5,914,209, the disclosure of which is totally incorporated by reference, there is illustrated a process of preparing MICR toners using a combination of hard and soft magnetites and lubricating, and melt mixing this combination with a resin followed by jetting and classifying the blend to provide toner compositions.

In U.S. Pat. No. 4,517,268, the disclosure of which is totally incorporated by reference, there is illustrated a process for the preparation of MICR toners by melt mixing the appropriate components in a Banbury apparatus, following by pulverizing the magnetite and the resin, and then jetting and classifying to provide, for example, about 10 to about 12 micron toner size particles, which when mixed with an additive package and carrier can provide a developer suitable for the Xerox Corporation 9700®.

Other patents relating to MICR processes include U.S. Pat. Nos. 4,859,550; 5,510,221, and 5,034,298.

In U.S. Pat. No. 5,780,190 there is disclosed an ionographic process which comprises the generation of a latent image comprised of characters; developing the image with an encapsulated magnetic toner comprised of a core comprised of a polymer and soft magnetite, and wherein the core is encapsulated within a polymeric shell; and subsequently providing the developed image with magnetic ink characters thereon to a reader/sorter device.

Illustrated in U.S. Pat. No. 4,758,506, the disclosure of which is, totally incorporated herein by reference, are single component development cold pressure fixable toner compositions, wherein the shell selected can be prepared by an interfacial polymerization process. Also known are single component magnetic cold pressure fixable toner compositions comprised of magnetite and a polyisobutylene encapsulated in a polymeric shell material generated by an interfacial polymerization process.

In applications requiring MICR capabilities, the toners selected usually contain magnetites having specific properties, an important one of which is a high enough level of remanence or retentivity. Retentivity is a measure of the magnetism remaining when the magnetite is removed from the magnetic field, i.e. the residual magnetism. Also, of interest is a high retentivity such that when the characters are read, the magnetite produces a sufficient signal strength. The magnetic signal level is of value in MICR systems, and the signal level can vary in proportion to the amount of toner deposited on the document being generated; the signal strength of the toner composition can be measured by using known devices, including the MICR-Mate 1, manufactured by Checkmate Electronics, Inc.

In forming toner compositions for use with reprographic or xerographic print devices, emulsion aggregation processes are known. For example, emulsion/aggregation/coalescing processes for the preparation of toners are illustrated in a number of Xerox patents, the disclosures of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658; 5,585,215; 5,650,255; 5,650,256 and 5,501,935; 5,723,253; 5,744,520; 5,763,133; 5,766,818; 5,747,215; 5,827,633; 5,853,944; 5,804,349; 5,840,462; 5,869,215; 5,869,215; 5,863,698; 5,902,710; 5,910,387; 5,916,725; 5,919,595; 5,925,488 and 5,977,210.

In addition, the following U.S. Patents relate to emulsion aggregation processes of forming toner compositions, the disclosures of which are each totally incorporated herein by reference.

U.S. Pat. No. 5,922,501 describes a process for the preparation of toner comprising blending an aqueous colorant dispersion and a latex resin emulsion, and which latex resin is generated from a dimeric acrylic acid, an oligomer acrylic acid, or mixtures thereof, and a monomer; heating the resulting mixture at a temperature about equal, or below about the glass transition temperature (Tg) of the latex resin to form aggregates; heating the resulting aggregates at a temperature about equal to, or above about the Tg of the latex resin to effect coalescence and fusing of the aggregates; and: optionally isolating the toner product, washing, and drying.

U.S. Pat. No. 5,945,245 describes a surfactant free process for the preparation of toner comprising heating a mixture of an emulsion latex, a colorant, and an organic complexing agent.

U.S. Pat. No. 5,482,812 describes a process for the preparation of toner compositions or toner particles comprising (i) providing an aqueous pigment dispersion comprised of a pigment, an ionic surfactant, and optionally a charge control agent; (ii) providing a wax dispersion comprised of wax, a dispersant comprised of nonionic surfactant, ionic surfactant or mixtures thereof; (iii) shearing a mixture of the wax dispersion and the pigment dispersion with a latex or emulsion blend comprised of resin, a counterionic surfactant with a charge polarity of opposite sign to that of said ionic surfactant and a nonionic surfactant; (iv) heating the above sheared blend below about the glass transition temperature (Tg) of the resin to form electrostatically bound toner size aggregates with a narrow particle size distribution; (v) adding additional ionic surfactant to the aggregated suspension'of (iv) to ensure that no, or minimal additional particle growth of the electrostatically bound toner size aggregates occurs on further increasing the temperature to coalesce the aggregates into toner particles (vi); (vi) heating the mixture of (v) with bound aggregates above about or at the Tg of the resin; and optionally (vii) separating the toner particles from the aqueous slurry by filtration, and thereafter optionally washing.

U.S. Pat. No. 5,622,806 describes a process, for example, for the preparation of toner compositions with controlled particle size comprising (i) preparing a pigment dispersion in water, which dispersion is comprised of a pigment, an ionic surfactant in amounts of from about 0.5 to about 10 percent by weight to water, and an optional charge control agent; (ii) shearing. the pigment dispersion with a latex mixture comprised of a counterionic surfactant with a charge polarity of opposite sign to that of the ionic surfactant, a nonionic surfactant, and resin particles, thereby causing a flocculation or heterocoagulation of the formed particles of pigment, resin, and charge control agent; and (iii) stirring.

The disclosures of the above-identified patents are totally incorporated by reference.

SUMMARY

It is a feature of the present invention to provide a magnetite containing toner for Magnetic Ink Character Recognition processes by, for example, using a specific type of magnetite to provide an acceptable readability signal by a check reader.

In another feature of the present invention, there is provided a process for the preparation of a MICR toner by an emulsion aggregation process in which the magnetite or the iron oxide pigment particles can also function as a coagulating agent; thus the magnetite particles can exhibit positive charging characteristics in acidic or low pH conditions, and exhibit negative charging characteristics in basic or high pH conditions, thereby allowing the magnetite particles to function as a coagulating agent at low pH or acidic conditions without the need for any external coagulating agents such as polymetal halides or polymetal sulfosilicates.

Another feature of the present invention resides in the use of magnetite and other oxide particles of, for example, titanium, aluminum, zirconium, and the like, which exhibit a dual charge depending on the pH of the surrounding media, allowing these particles to function as coagulating/flocculating agents for anionic or cationic systems. The anionic latexes, which are generally acidic, are aggregated together with the anionic wax dispersion using magnetite particles that exhibit a positive charge under acidic conditions, for example, at a pH of about 1.5 to about 5.5, and therefore act as a flocculating agent. Cationic latexes with a basic pH of, for example, about 7.5 to about 10 can readily be aggregated with a cationic wax dispersion using magnetite particles that exhibit a negative charge in basic pH conditions, thereby acting as a flocculating agent. Magnetite particles, when dispersed in water in the presence of an anionic or optionally a nonionic surfactant, provide a magnetite dispersion with the resulting dispersion generally neutral in pH where the pH is, for example, of about 6.5 to about 7 and where the surface charge of the magnetite particle is neutral, for example about 0 to about −2 coulombs/cm$^2$. By introducing an acidic anionic latex whose pH is of about 1.5 to about 2.5 to the magnetite dispersion, there is induced a positive charge on the magnetic particles thereby acting as a flocculating agent for the anionic species.

It is a further feature of the present invention to provide a MICR toner prepared by emulsion aggregation wherein the particle morphology can be tailored from, for example, a potato to spherical shape.

It is also a feature of the present invention. that there is provided a MICR toner by emulsion aggregation process by the full incorporation of needle shape or acicular magnetite particles, which are of a size diameter of, for example, about 450 nanometers to about 700 nanometers.

It is yet another feature of the present invention to provide a process that is; capable of incorporating into toners needle shape or acicular magnetite which have a coercivity of about twice that of cubic or spherical magnetites to thereby provide an adequate magnetic signal for readability by commercial check readers.

In another feature of the present invention there is provided a process for the preparation of a MICR toner by emulsion aggregation process wherein the amount of acicular magnetite loading is about 25 to about 35 weight percent of toner. Also, for example, about 45 to about 65 weight percent of cubic or spherical magnetite smaller in size than acicular magnetite, about 0.1 micron, with low magnetization power can be selected. To compensate for this, the magnetite loading is increased to provide a MICR signal, an adequate magnetic signal for readability by a check reader.

The signal is the measure of the standard calibration document as defined by the Banker's Association Standard and Specifications for MICR Encoded Document. Generally, each country sets a minimum percent signal level, for example the minimum signal level in the USA is 50 percent of the nominal, while in Canada it is 80 percent of the nominal. To ensure latitude in the printing process, it is generally desirable to exceed the nominal specification, for example the target signal which is about 115 to about 130 percent of the nominal to minimize the document rejection rates.

EMBODIMENTS

Aspects of the present invention relate to a process for the preparation of a magnetic toner comprising mixing a colorant dispersion containing acicular magnetite, a carbon black dispersion, a latex emulsion, and a wax dispersion; a process wherein (i) the acicular magnetite dispersion. contains water and an anionic surfactant, or a nonionic surfactant, and the dispersion of carbon black contains water and an anionic surfactant, or a nonionic surfactant, and wherein the carbon black dispersion possesses a pH of about 6.3 to about 6.8, and wherein the latex is an emulsion comprised of an anionic surfactant, water and resin, and which emulsion is at a pH of about 1.5 to about 2.5;

(ii) wherein the colorant dispersion is blended with the latex emulsion, and thereafter a wax dispersion is added comprised of submicron wax particles of from about 0.1 to about 0.5 micron in diameter by volume, and which wax is dispersed in an anionic surfactant;

(iii) wherein the resulting blend possesses a pH of about 2.2 to about 2.8 thereby inducing a positive charge on the magnetite particles to thereby initiate flocculation or aggregation of the resin latex, the colorant, and the wax;

(iv) heating the resulting mixture below about the glass transition temperature (Tg) of the latex resin to form toner sized aggregates;

(v) adding to the formed toner aggregates a second latex comprised of resin suspended in an aqueous phase containing an ionic surfactant and water, and stirring for a period of time to permit stabilization of the aggregate particle size;

(vi) adding to the resulting mixture a base to thereby change the pH, which is initially from about 2 to about 2.8, to arrive at a pH of from about 6.9 to about 7.3 for the resulting toner aggregate mixture;

(vii) heating the resulting aggregate suspension of (vi) above about the Tg of the latex resin of (i), while maintaining the pH at a value of about 6.9 to about 7.3;

(viii) retaining the mixture temperature at from about 85° C. to about 95° C. for an optional period of about 10 to about 60 minutes, followed by a pH reduction with an acid to arrive at a pH of about 5.3 to about 5.8;

(ix) retaining the mixture temperature at from about 85° C. to about 95° C. for a period of about 7 to about 14 hours to assist in permitting the fusion or coalescence of the toner aggregates and to obtain smooth particles;

(x) washing the resulting toner slurry; and (xi) isolating the toner; a process wherein the magnetite dispersion contains an anionic surfactant and a nonionic surfactant wherever the dispersion possesses a pH of from about 6.5 to about 6.8; a process wherein the carbon black dispersion comprises particles dispersed in water and an anionic surfactant, and which dispersion possesses a pH of about 6.3 to about 6.8; a process wherein the acicular magnetite is present in an amount of from about 20 to about 35 percent by weight of toner, and wherein in the presence of an acidic anionic latex the magnetite is charged positively thereby facilitating aggregation; a process wherein the acicular magnetite is present in an amount of from about 23 to about 32 percent by weight of toner, and wherein in the presence of an acidic anionic latex functions as positively charged particles thereby facilitating aggregation; a process wherein the acicular magnetite utilized exhibits a coercivity of from about 250 to about 700 Oe; a process wherein the acicular magnetite has a particle size of about 0.6 micron in length by 0.1 micron in diameter, and is comprised of about 21 percent FeO and about 79 percent $Fe_2O_3$; a process wherein the toner exhibits a magnetic signal of from about 115 to about 150 percent of the nominal signal; a process wherein the toner possesses a minimum fix temperature (MFT) of about 170° C. to about 195° C.; a process wherein the toner hot offset temperature (HOT) is in excess of about 210° C.; a process wherein the magnetite dispersion is obtained by a ball milling, attrition, polytroning or media milling resulting in magnetite particles dispersed in water containing an anionic surfactant; a process wherein the carbon black dispersion is present in an amount of about 4 to about 8 percent by weight of toner; a process wherein the latex resin particles are from about 0.15 to about 0.3 micron in volume average diameter; a process wherein the magnetite is of a size of about 0.6 micron to about 0.1 micron, and the carbon black is of a size of about 0.01 to about 0.2 micron in average volume diameter; a process wherein the acid is selected from the group consisting of nitric, sulfuric, hydrochloric, citric and acetic acid; a process wherein the base is selected from the group consisting of sodium hydroxide, potassium hydroxide, and ammonium hydroxide; a process wherein there is added to the formed toner aggregates a second latex comprised of submicron resin particles suspended in an aqueous phase containing an anionic surfactant, and wherein the second latex is selected in an amount of from about 10 to about 40 percent by weight of the initial latex to form a shell thereover on the formed aggregates, and which shell is of a thickness of, for example, about 0.2 to about 0.8 micron; a process wherein the added latex contains the same resin as the initial latex of (i), or wherein the added latex contains a dissimilar resin than that of the initial latex; a process wherein the pH of the mixture resulting in (vi) is increased from about 2 to about 2.6 to about 6.5 to about 7.2, and wherein an added base functions primarily as a stabilizer for the aggregates during coalescence (vii), and no or minimal toner particle size or GSD increases result; a process wherein the temperature at which toner sized aggregates are formed controls the size of the aggregates, and wherein the final toner size is from about 5 to about 12 microns in volume average diameter; a process wherein the aggregation (iv) temperature is from about 45° C. to about 60° C., and wherein the coalescence or fusion temperature of, for example, (vii) and (viii) is from about 85° C. to about 95° C.; a process wherein the time of coalescence or fusion is from about 12 to about 20 hours, and wherein thereon are provided toner particles with a smooth morphology; a process wherein the latex contains a resin or polymer selected from the group consisting of poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid); a process wherein the latex contains a resin selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid); a process wherein the magnetite functions as a positively charged coagulant; a process comprising mixing a colorant dispersion containing acicular magnetite, a carbon black dispersion, a latex emulsion and a wax dispersion; a process for the preparation of a MICR toner comprising (i) providing an acicular magnetite dispersion which contains water, and an anionic surfactant, or a nonionic surfactant, and a carbon black dispersion of water and an anionic surfactant, or a nonionic surfactant, wherein the pH of the dispersion is about 6.5 and wherein the latex selected is an emulsion comprised of an anionic surfactant, water and resin, and which emulsion is at a pH of about 1.8;

(ii) wherein the colorant dispersion is blended with the latex emulsion, and thereafter adding a wax dispersion comprised of submicron wax particles of from about 0.1 to about 0.5 micron in diameter by volume and which wax is dispersed in an anionic surfactant;

(iii) resulting in a blend possessing a pH of about 2.2 to about 2.8 thereby inducing a positive charge on the magnetite particles to thereby initiate flocculation or aggregation of the resin latex, the colorant, and the wax;

(iv) heating the resulting mixture below about, or about equal to the glass transition temperature (Tg) of the latex resin to form toner sized aggregates;

(v) adding to the formed toner aggregates a second latex comprised of resin suspended in an aqueous phase containing an ionic surfactant and water, and stirring for a sufficient period of time to permit stabilization of the aggregate particle size;

(vi) adding to the resulting mixture a base to thereby change the pH, which is initially from about 2 to about 2.8, to arrive at a pH of from about 6.9 to about 7.3 for the resulting toner aggregate mixture;

(vii) heating the resulting aggregate suspension of (vi) above about the Tg of the latex resin of (i), while maintaining the pH at a value of about 6.9 to about 7.3;

(viii) retaining the mixture temperature at from about 85° C. to about 95° C. optionally for a period of about 10 to about 60 minutes, followed by a pH reduction with an acid to arrive at a pH of about 5.3 to about 5.8;

(ix) retaining the mixture temperature from about 85° C. to about 95° C. for a period of about 7 to about 14 hours to assist in permitting the fusion or coalescence of the toner aggregates and to obtain smooth particles;

(x) washing the resulting toner slurry; and (xi) isolating the toner;

a toner process wherein the magnetite dispersion can be obtained by ball milling, attrition, polytroning, media milling, and the like resulting in stabilized magnetite or iron oxide particles in water containing an anionic surfactant wherein the carbon black dispersion is present in an amount of about 4 to about 8 percent by weight of toner; the latex resin particles are from about 0.15 to about 0.3 micron in volume average diameter; the magnetite is of a size of about 0.6 micron to about 0.1 micron, and the carbon black is of a size of about 0.01 to about 0.2 micron in average volume diameter; the acid is selected from the group consisting of nitric, sulfuric, hydrochloric, citric and acetic acid; the base is selected from the group consisting of sodium hydroxide, potassium hydroxide, and ammonium hydroxide; there is added to the formed toner aggregates a second latex comprised of resin particles suspended in an aqueous phase containing an anionic surfactant, and wherein the second latex is selected in an amount of from about 10 to about 45 percent by weight of the Initial latex to, for example, form a shell thereover on the formed aggregates, and which shell is of a thickness of, for example, about 0.2 to about 0.8 micron; added latex contains the same resin as the initial latex, or wherein the added latex contains a dissimilar resin than that of the initial latex; the pH of the mixture resulting in (vi) is increased from about 2 to about 2.6 to about 6.5 to about 7.2, and wherein the base functions primarily as a stabilizer for the aggregates during coalescence; the temperature at which toner sized aggregates are formed controls the size of the aggregates, and wherein the final toner size is from about 5 to about 9 microns in volume average diameter; the aggregation (iv) temperature is from about 45° C. to about 60° C., and wherein the coalescence or fusion temperature is from about 85° C. to about 95° C.; the time of coalescence or fusion is from about 12 to about 20 hours, and wherein in embodiments there are provided toner particles with a smooth morphology;

a process for the preparation of a toner composition comprising (i) forming a resin latex dispersion of a resin in an aqueous ionic surfactant solution from a latex utilizing an ionic surfactant wherein the latex pH is about 1.5 to about 2.8; (ii) preparing a pigment dispersion in water and wherein the pigment Is an acicular magnetite or an iron oxide pigment dispersed in water and an anionic surfactant dispersion wherein the pH of the dispersion is about 6.3 to about 7 and adding an anionic dispersion of a carbon black pigment; (iii) blending the acidic resin latex dispersion with the pigment dispersion of (ii), followed by the addition of an anionic wax dispersion to form a resin/magnetite/pigment/wax blend whose pH is about 2.5, thereby inducing a positive charge on the magnetite surface to initiate flocculation or aggregation of the resin, carbon black and wax particles on the magnetite particles; (iv) continuously subjecting the mixture to high shear to form a homogeneous gel of the resin-pigment wax blend; (v) heating the sheared gel at a temperature below the glass transition temperature (Tg) of the resin while continuously stirring to form aggregate particles; (vi) following a suitable period of time to permit stabilization of aggregate particle size, adding a latex comprised of the same latex formulation as that of (i), or optionally an anionic latex comprised of a different formulation than that of (i); (vii) modifying the pH of the slurry to a pH of about 6.6 to about 7.5 to prevent any further growth of the aggregate particles of (vi); (vii) heating the aggregate particles at a temperature above the Tg of the latex resin, followed by lowering the pH of the aggregate particles to about 5.3 and heating further for a period of about 7 to about 14 hours to form coalesced particles of a toner composition; and (viii) separating and drying the toner composition; a toner composition process comprising (i) forming an acidic anionic resin latex dispersion of a resin in an aqueous anionic surfactant solution from a latex utilizing a nonionic surfactant which dispersion possesses a pH of about 1.8; (ii) preparing a pigment dispersion of an acicular magnetite pigment dispersed in water and an anionic dispersant, and optionally nonionic dispersant, adding an additional anionic pigment dispersion of carbon black with a pH of about 6.5; (iii) blending about 80 to about 99 percent by weight of the total amount of the resin latex dispersion to be added in the process with the pigment dispersion mixture to which is added an anionic wax dispersion comprised of wax particles suspended in water in the presence of an anionic surfactant to form a resin/pigments/wax blend with a pH of about 2.6 thereby inducing a positive surface charge on the magnetite particles which function as a coagulant to initiate flocculation or aggregation; (iv) continuously subjecting the mixture to high shear to induce a homogeneous gel of the blend; (v) heating the sheared gel at a temperature below the glass transition temperature (Tg) of the latex resin while continuously stirring to form toner size aggregate particles; (vi) following a period of time to permit stabilization of aggregate particle size (vii) adding the remaining portion of the resin latex dispersion; (vii) changing the pH of the slurry to greater than a pH of about 6.5 to stabilize the particles; (viii) then heating the aggregate particles at a temperature of above the Tg of the resin, followed by reducing the pH to about 5.3 in stages over a period of about 60 to about 90 minutes, and further heating the mixture for a period of about 7 to about 14 hours to form coalesced particles of a toner composition; and (ix) separating and drying the toner composition; a process comprising mixing colorant dispersions of acicular magnetite and carbon black (whose initial or starting pH is about 6.5 wherein the magnetite particles have neutral or slightly negative surface charge, a latex emulsion whose initial pH is about 1.8 and adding a wax dispersion resulting in a blend of latex pigments and wax particles resulting in a pH of about 2.6; the resulting change in the pH of the magnetite pigment dispersion induces a positive surface charge thereby permitting it to also function as a coagulant to initiate flocculation or aggregation of the resin, carbon black and the wax particles on the surface of the magnetite particles; a process wherein the colorant dispersions are comprised of (i) iron oxide, water, and an anionic surfactant, and carbon black, water and an anionic surfactant, or a nonionic surfactant with a pH of about 6.5; and wherein the latex is an emulsion comprised of an anionic surfactant, water and resin with a pH of about 1.8;

(ii) wherein the colorant dispersion is blended with the latex emulsion, and thereafter adding a wax dispersion comprised of submicron wax particles of from about 0.1 to about 0.5 micron in diameter by volume, which wax is dispersed in an anionic surfactant;

(iii) wherein the resulting blend has a pH of about 2.6 thereby inducing a positive charge on the magnetite particles to thereby initiate flocculation or aggregation of the resin latex, the colorants, and the wax when present;

(iv) heating the resulting mixture below about, or about equal to the glass transition temperature (Tg) of the latex resin to form toner sized aggregates;

(v) adding to the formed toner aggregates a second latex comprised of a resin suspended in an aqueous phase containing an ionic surfactant and water, and stirring for a period of time to permit stabilization of the aggregate particle size;

(vi) adding to the resulting mixture a base to thereby change the pH, which is from about 2 to about 2.9, to arrive at a pH of from about 7 for the resulting toner aggregate mixture;

(vii) heating the resulting aggregate suspension of (vi) above about the Tg of the latex resin of (i), while maintaining the pH at a value of about 7;

(viii) retaining the mixture temperature at from about 85° C. to about 95° C. optionally for a period of about 10 to about 60 minutes, followed by a pH reduction with an acid to arrive at a pH of about 5.5;

(ix) further, retaining the mixture temperature from about 85° C. to about 95° C. for a period of about 7 to about 14 hours to assist in permitting the fusion or coalescence of the toner aggregates to obtain smooth particles;

(x) washing the resulting toner slurry; and (xi) isolating the toner; a process wherein the blending and aggregation are performed in the pH range of about 2 to about 3 and preferably about 2.1 to about 2.8, while the coalescence is initially conducted in the pH range of about 6.5 to about 7.5 followed by a reduction in pH to a range of about 5.2 to about 5.8 followed by further heating for a period of about 7 to about 14 hours; a process for preparing a MICR toner composition by emulsion aggregation process, and which toner contains about 25 to about 35 weight percent of acicular or needle shape magnetite, and wherein there are provided smooth particles with a particle size distribution as measured on a Coulter Counter of about 1.20 to about 1.26, a MICR signal in the range of about 115 to about 130 percent and a bulk remanence of about 26 emu/g, wherein the remanence is measured on a tapped powder magnetite sample in a cell of 1 centimeter by 1 centimeter by about 4 centimeters. The sample is magnetized between two magnetic pole faces with a saturating magnetic field of 2,000 Gauss, such that the induced magnetic field is perpendicular to one of the 1 by 4 centimeter faces of the cell. The sample is removed from the saturating magnetic field, and the remanence is measured perpendicular to the above 1 centimeter wide face using a Hall-Effect device or a gaussmeter, such as the F. W. Bell, Inc. Model 615 gaussmeter.

When the magnetite is placed in aqueous environments, it then results in a surface charge polarity change from positive at low pH, for example about 2 to about 3, to a negative at high pH of, for example, about 8 to about 9. This behavior is related to the manner in which the water and the hydroxide (OH) groups interact with the oxide surface. At room temperature, for example 25° C., the magnetite surface has a point of zero charge (Pzc) corresponding to a pH of 6.5. The magnetite charge increases negatively quite strongly with increasing pH. Below the Pzc, the surface charge of the magnetite increases positively with decreasing pH. At or slightly above the room temperature the magnetite is positively charged in acidic media, such as that of the acidic anionic latex having a pH in the range of about 1.5 to about 3.5. The positive charge induced causes the magnetite particles to act as coagulating agent for anionic species, such as the anionic latex, the anionic carbon black dispersion and the anionic wax dispersion resulting in a heterocoagulation of the above. At about 30 weight percent loading of the acicular magnetite, there is sufficient positive charge generated to coagulate the latex, carbon black and the wax particles. Loading of less than 30 weight percent, for example 20 percent, there is required an external coagulant, such as metal halides, for example polyaluminum chloride, to provide narrow particle size distribution, for example 1.20 to 1.25. The point of zero charge (PZC) also moves with time, for example at 25° C. the PZC is at a pH of 6.5 and as the temperature is increased the PZC decreases in pH, where for example at the coalescence temperature of 93° C. the PZC is 5.3. Therefore; any attempts to lower the pH below this value can result in induction or regeneration of +charge resulting in a growth in particle size.

The colorant dispersion comprises in embodiments acicular magnetite particles dispersed in water, an anionic surfactant and a nonionic surfactant when, for example, the dispersion possesses pH of from about 6.5 to about 6.8; the carbon black particles can be dispersed in water at a pH of about 6.5 to about 6.8; the acicular magnetite amount is, for example, from about 20 to about 35 percent by weight of toner, and in the presence of an acidic or "sour" latex functions as a positively charged particle thereby facilitating aggregation; and wherein in embodiments when the acicular magnetite amount is from about 23 to about 32 percent by weight of toner and in the presence of an acidic anionic latex it acts as a positively charged particle thereby facilitating aggregation; wherein the acicular magnetite utilized exhibits a coercivity of from, for example, about 250 to about 700 Oe; wherein the acicular magnetite, which can be comprised of 21 percent FeO and 79 percent $Fe_2O_3$, is selected from the group consisting of B2510, B2540, B2550, HDM-S 7111 with a coercivity of from about 250 to about 500 Oe, a remanent magnetization (Br) of about 23 to about 39 emu/g, and a saturation magnetization (Bm) of about 70 to about 90 emu/g, all these magnetites being available from Magnox; MR-BL with a coercivity of 340 Oe, a remanent magnetization (Br) of about 34 emu/g, and where saturation magnetization (Bm) is about 85 emu/g, all available from Titan Kogyo; and Columbia Chemicals; MTA-740 with a coercivity of about 370 Oe, a remanent magnetization (Br) of about 30 emu/g, and a saturation magnetization (Bm) of about 83 emu/g, available from Toda Kogyo; AC 5151M with a coercivity of about 270 Oe, a remanent magnetization (Br) of about 20 emu/g, and a saturation magnetization (Bm) of about 79 emu/g, all available from Bayer; M08029, M04232, M04431 with a coercivity of from about 250 to about 400 Oe, a remanent magnetization (Br) of about 23 to about 60 emu/g, and a saturation magnetization (Bm) of about 70 to about 90 emu/g, all available from Elementis, Inc.; acicular magnetites with 20 percent FeO and 80 percent $Fe_2O_3$, a coercivity of about 250 to about 700 Oe, and with a particle size of about 0.6 micron in length×0.1 micron in diameter; B2510, B2540, B2550, HDM-S 7111 with a coercivity of from about 250 to about 500 Oe, a remanent magnetization (Br) of about 23 to about 39 emu/g, and a saturation magnetization (Bm) of about 70 to about 90 emu/g, all available from Magnox; MR-BL with a coercivity of about 340 Oe, a remanent magnetization (Br) of about 34 emu/g, and a saturation magnetization (Bm) of about 85 emu/g, available from Titan Kogyo and Columbia Chemicals; MTA-740 with a coercivity of about 370 Oe, a remanent magnetization (Br) of about 30 emu/g, and a saturation magnetization (Bm) of about 83 emu/g, available from Toda Kogyo; AC 5151M with a coercivity of about 270 Oe, a remanent magnetization (Br) of about 20 emu/g, and a saturation magnetization (Bm) of about 79 emu/g, available from Bayer; M08029, M04232, M04431 with a coercivity of from about 250 to about 400 Oe, a remanent magnetization (Br) of about 23 to 60 emu/g, and a saturation magnetization (Bm) of about 70 to about 90 emu/g, all available from Elementis, Inc.; the acicular magnetite selected is present in an amount of from about 10 to about 35 weight percent, and more specifically, in an amount of about 22 to about 32 weight percent by weight of toner.

Cubic magnetites are disclosed which possess a coercivity of about 80 to about 240 Oe, such as BL100, BL200, BL220, BL250, RB-BL with a coercivity of from about 70 to about 250 Oe, and a saturation magnetization (Bm) of about 70 to about 90 emu/g, all available from Titan Kogyo; MG-WSC, MG-WS, MG-WSE with a coercivity of from about 100 to about 240 Oe, a remanent magnetization (Br) of about 10 to about 25 emu/g, and a saturation magnetization (Bm) of about 70 to about 90 emu/g, available from Mitsui; EPT500, EPT1000, MAT210, MAT222, WAT103 with a coercivity of from about 120 to about 150 Oe, a remanent magnetization (Br) of about 10 to about 20 emu/g, and a saturation magnetization (Bm) of about 70 to about 90 emu/g, available from Toda Kogyo; TB-WM, TB-DR, Tonetite CA with a coercivity of from about 90 to about 150 Oe, a remanent magnetization (Br) of about 15 to about 30 emu/g, and a saturation magnetization (Bm) of about 65 to about 90 emu/g, available from Tone Industry; TB5600, TB5700, TB5800, TB5900 with a coercivity of from about 100 to about 150 Oe, a remanent magnetization (Br) of about 9 to about 15 emu/g, and a saturation magnetization (Bm) of about 80 to about 90 emu/g, available from Elementis, Inc.; and TX393 Mapico Black, Mapico Black B with a coercivity of from about 50 to about 100 Oe, a remanent magnetization (Br) of about 8 to about 17 emu/g, and a saturation magnetization (Bm) of about 70 to about 80 emu/g, available from Laporte pigments.

The latex contains a resin or polymer selected from the group consisting of poly(styrene-alkyl acrylate), poly (styrene-1,3-diene), poly(styrene-alkyl methacrylate), poly (styrene-alkyl acrylate-acrylic acid), poly(styrene-1,3-diene-acrylic acid), poly(styrene-alkyl methacrylate-acrylic acid), poly(alkyl methacrylate-alkyl acrylate),. poly(alkyl methacrylate-aryl acrylate), poly(aryl methacrylate-alkyl acrylate), poly(alkyl methacrylate-acrylic acid), poly (styrene-alkyl acrylate-acrylonitrile-acrylic acid), poly (styrene-1,3-diene-acrylonitrile-acrylic acid), and poly(alkyl acrylate-acrylonitrile-acrylic acid); or the latex contains a resin selected-from the group consisting of poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid).

Magnetic characteristics associated with the toners generated with the processes of the present invention include, for example, differing shape and excellent magnetic characteristic configuration of each character. For example, in a typical signal strength test, a MICR-Mate 1 reading device is calibrated to read the "on-us" character as 100 percent signal strength defined as the nominal. The relative signal strength of test characters for a given toner composition are then measured by reading their characters with the calibrated device. Each test character will read more or less than 100 percent signal strength. The signal is the measure of the standard calibration document as defined by-the Banker's Association Standard and Specifications for MICR Encoded Document. Generally, each country sets a minimum percent signal level, for example the minimum signal level in the USA is 50 percent of the nominal, while in Canada it is 80 percent of the nominal. To ensure latitude in the printing process, it is generally desirable to exceed the nominal specification, for example the target signal which is about 115 to about 130 percent of the nominal to minimize the document rejection rates.

As the viscosity of the resin inside the aggregates decreases (i.e. begins to flow), the magnetite particles can diffuse inside the aggregates and align since there is sufficient concentration of the magnetite particle in comparison to the resin. As the heating is continuously applied to coalesce the aggregate particles, the aggregates themselves begin to align with each other forming a chain. Hot aggregates in contact fuse together and this is observed by the increase in the particle size and the broadening of the particle size distribution.

Illustrative examples of resin particles selected for the process of the present invention include known polymers selected from the group consisting of poly(styrene-butadiene), poly(para-methyl styrenebutadiene), poly(meta-methyl styrene-butadiene), poly(alpha-methyl styrene-butadiene), poly(methylmethacrylate-butadiene), poly (ethylmethacrylate-butadiene), poly(propylmethacrylate-butadiene), poly(butylmethacrylate-butadiene), poly (methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(meta-methyl styrene-isoprene), poly (alpha-methylstyrene-isoprene), poly(methylmethacrylate-isoprene), poly(ethylmethacrylate-isoprene), poly (propylmethacrylate-isoprene), poly(butylmethacrylate-isoprene), poly(methylacrylate-isoprene), poly (ethylacrylate-isoprene), poly(propylacrylate-isoprene), and poly(butylacrylate-isoprene); and terpolymers such as poly (styrene-butadiene-acrylic acid), poly(styrene-butadiene-methacrylic acid), PLIOTONE™ available from Goodyear, polyethylene-terephthalate, polypropylene-terephthalate, polybutylene-terephthalate, polypentylene-terephthalate, polyhexalene-terephthalate, polyheptadene-terephthalate, polyoctalene-terephthalate, POLYLITE™ (Reichhold Chemical Inc.), PLASTHALL™ (Rohm & Haas), CYGAL™ (American Cyanamide), ARMCO™ (Armco Composites), ARPOL™ (Ashland Chemical), CELANEX™ (Celanese Eng), RYNITE™ (DuPont), and STYPOL™.

The resin particles selected, which generally can be in embodiments styrene acrylates, styrene butadienes, styrene methacrylates, or polyesters, are present in various effective amounts, such as from about 70 weight percent to about 98 weight and preferably between 80 and 92 percent of the toner, and can be of small average particle size, such as from about 0.01 micron to about 1 micron in average volume diameter as measured by the Brookhaven nanosize particle analyzer. Other effective amounts of resin can be selected.

The resin particles selected for the process of the present invention are preferably prepared by, for example, emulsion polymerization techniques, including semicontinuous emulsion polymerization methods, and the monomers utilized in such processes can be selected from, for example, styrene, acrylates, methacrylates, butadiene, isoprene, and optionally acid or basic olefinic monomers such as acrylic acid, methacrylic acid, acrylamide, methacrylamide, quaternary ammonium halide of dialkyl or trialkyl acrylamides or methacrylamide, vinylpyridine, vinylpyrrolidone, vinyl-N-methylpyridinium chloride and the like. The presence of acid or basic groups in the monomer, or polymer resin is optional, and such groups can be present in various amounts of from about 0.1 to about 10 percent by weight of the polymer resin. Chain transfer agents, such as dodecanethiol or carbon tetrabromide, can also be selected when preparing resin particles by emulsion polymerization. Other processes of obtaining resin particles of from about 0.01 micron to about 1 micron can be selected from polymer microsuspension process, such as illustrated in U.S. Pat. No. 3,674,736, the disclosure of which is totally incorporated herein by reference, polymer solution microsuspension process, such as disclosed in U.S. Pat. No. 5,290,654, the disclosure of which is totally incorporated herein by reference, mechanical grinding process, or other known processes.

Examples of anionic surfactants suitable for use in the resin latex dispersion include, for example, sodium dodecylsulfate (SDS), sodium dodecylbenzene sulfonate, sodium dodecyinaphthalene sulfate, dialkyl benzenealkyl, sulfates and sulfonates, abitic acid, available from Aldrich, NEOGEN RK™, NEOGEN SC™ from Kao, and the like. An effective concentration of the anionic surfactant generally employed is, for example, from about 0.01 to about 10 percent by weight, and preferably from about 0.1 to about 5 percent by weight of monomers used to prepare the toner polymer resin.

Examples of nonionic surfactants that may be included in the resin latex dispersion include, for example, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol (available from Rhodia as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. A suitable concentration of the nonionic surfactant is, for example, from about 0.01 to about 10 percent by weight, and preferably from about 0.1 to about 5 percent by weight of monomers used to prepare the toner polymer resin.

Examples of dispersants that are suitable for dispersing the magnetite particles include functional copolymers, for example methyl vinyl ether-maleic acid, methyl vinyl ether-maleic acid calcium sodium salt, hydrophobically modified polyethers, polyvinylpyrrolidone homopolymers, alkylated vinylpyrrolidone copolymers, vinyl acetate/vinylpyrrolidone copolymers, vinylpyrrolidone/styrene block, poly(methyl vinyl ether/maleic anhydride) (linear interpolymer with 1:1 molar ratio), dimethylaminoethyl methacrylate, ethylene-vinyl acetate copolymer of maleic anhydride and acrylic acid, polystyrene-maleic anhydride, styrene-acrylic ester, ethyl acrylate/methyl methacrylate, carboxylated poly-n-butyl acrylates, ethylene vinyl alcohol, and the like; and be readily dispersible into submicron particles of about 30 to about 400 nanometers in either an acid or a base resulting in a magnetite that is stabilized by resin particles.

In some instances, pigments are available in the wet cake or concentrated form containing water, and can be easily dispersed utilizing a homogenizer or simply by stirring or ball milling or attrition, or media milling. In other instances, pigments are available only in a dry form, whereby dispersion in water is effected by microfluidizing using, for example, a M-110 microfluidizer or an ultimizer and passing the pigment dispersion from 1 to 10 times through the chamber, or by sonication, such as using a Branson 700 sonicator or a homogenizer, or ball milling or attrition, or media milling with the optional addition of dispersing agents such as the aforementioned ionic or nonionic surfactants. In the instance of preparing carbon black pigment or other pigment dispersion, the above techniques can also be applied in the presence of a surfactant.

The foremost preferred magnetite for MICR application is an acicular magnetite followed by a mixture of acicular/cubic, or acicular/spherical magnetite, and with very limited use of extended to cubic or spherical magnetite on their own due to the defined MICR requirements.

The magnetite dispersion comprised of magnetite particles in water containing an anionic surfactant or a nonionic surfactant can be prepared by ball milling, attrition, polytroning or media milling resulting in magnetite particle stabilized by the surfactant, and wherein the dispersion is then aggregated with latex particles and wax particles to obtain a MICR toner.

Any suitable dispersant may be used in the pigment dispersion, including the nonionic and/or anionic surfactants identified above. Also, there is no particular limitation upon the solids content of the pigment dispersion. The solids content may range from, for example, about 10 to about 90 percent.

The resin latex dispersion and the pigment dispersion are first blended together. Any well known type of wax dispersion might also optionally be included in this blend including, for example, an aqueous based polyethylene wax containing an anionic surfactant as a dispersant. The blending obtains a resin-pigment wax blend. The blending may be effected by any suitable means known in the art, including stirring.

The magnetite pigment acting as a coagulant in the presence of an acidic anionic latex emulsion is preferably subjected to high shear, for example a rotor stator device by stirring with a blade at about 3,000 to about 10,000 rpm, most preferably about 5,000 rpm, for about 1 to about 120 minutes. A high shearing device, for example an intense homogenization device, such as the in-line IKA SD-41, may be used to ensure that the blend is homogeneous and uniformly dispersed. This high shear effects homogenization of the resin-pigment, and the wax when present.

Following homogenization, aggregation of the homogenized composition is effected by heating the composition to a temperature below the glass transition temperature (Tg) of the resin of the latex while agitating the composition. Most preferably, the temperature of the heating is from, for example, about 5° C. to about 20° C. below the Tg of the resin. The agitation preferably comprises continuously stirring the mixture using a mechanical stirrer at between, for example, about 200 to about 800 rpm.

The aggregation is conducted for a period of time until the aggregate particle size is stabilized, which may be for from, for example, about 10 minutes to about 6 hours. The addition of the delayed latex can be comprised of the same latex formulation that is used initially during the blending of the pigments comprised of magnetite dispersion, carbon black dispersion, latex and wax dispersion in the presence of a polymetal halide, or the latex can be comprised of a different composition, including molecular properties Tg.

Following aggregation and addition of all of the remaining delayed components into the composition, the particles are preferably coalesced by first changing the pH to about 6 to about 8 in order to stabilize the aggregates, followed by heating at a temperature above the Tg of the resin in the toner particles. Preferably, the heating for coalescing is conducted at a temperature of from about 10° C. to about 50° C., preferably about 25° C. to about 40° C., above the Tg of the resin for about 30 minutes to about 10 hours.

More specifically, during the coalescence the pH is increased, for example, in the range of from about 2 to about 3 to about 6.5 to about 7.5 by any suitable pH, increasing agent, for example sodium hydroxide. The increase in pH is essential in order to stabilize the aggregate particle and prevents any further growth and loss of GSD during further heat up, for example raising the temperature about 10° C. to about 50° C. above the resin Tg. After about 30 to about 90 minutes at the coalescence temperature, the pH is then gradually decreased back in the range of about 5.5 to about 6.5, wherein the reduction in pH permits the coalescence or the fusion process. The preferred pH reducing agents include, for example, nitric acid, citric acid, sulfuric acid or hydrochloric acid, and the likes.

In a preferred embodiment in the present invention, a multistage addition of latex is conducted. In particular, only a portion of the total amount of latex to be added into the composition is initially present in the composition subjected to homogenization and aggregation. In this embodiment, a majority of the latex is added at the onset while the remainder of the latex (the delayed latex) is added after the formation of the resin-pigment aggregates.

This delayed addition of latex improves formation of an outer shell of nonpigmented material around the pigmented core, thereby better encapsulating the pigment in the core of the particles and away from the toner particles surface where the presence of magnetite pigment can modify the charging behavior of the final toner particle. In other words, the addition of the remaining portion of the latex forms an outer shell around the already aggregated core particles.

Homogenization is essential to ensure the formation of particles with a narrow geometric size distribution (GSD), and insufficient homogenization may give rise to the formation of unwanted large sized aggregates.

Following the pH changes as described earlier, the coalesced toner particles obtained may optionally be separated and dried by any technique known in the art. The particles may also be washed with, for example, hot water to remove surfactant, and dried such as by use of an Aeromatic fluid bed dryer.

The toner particles may also include known charge additives in effective amounts of, for example, from about 0.1 to about 5 weight percent, such as alkyl pyridinium halides, bisulfates, the charge control additives of U.S. Pat. Nos. 3,944,493; 4,007,293; 4,079,014; 4,394,430 and 4,560,635, the disclosures of which are totally incorporated herein by reference, and the like. Surface additives that can be added to the toner compositions after washing or drying include, for example, metal salts, metal salts of fatty acids, colloidal silicas, metal oxides, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa in amounts of from about 0.1 to about 2 percent which can be added during the aggregation process or blended into the formed toner product.

Developer compositions can be prepared by mixing the toners obtained with the process of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

By the process of the invention, toner particles of acceptable size and narrow dispersity are obtained in a more rapid method than previously realized in the art. The toner particles preferably have an average volume diameter of from about 0.5 to about 25, and preferably from about 1 to about 10 microns, and a narrow GSD characteristic of from about 1.05 to about 1.25, and preferably from about 1.15 to about 1.25 as measured by a Coulter Counter. The toner particles also have an excellent shape factor, for example, of 120 or less, wherein the shape factor is described as a measure of smoothness and roundness, where a shape factor of 100 is considered perfectly. spherical and smooth, while a shape factor of 145 is considered to be rough in surface morphology and the shape is like a potato and is usually measured by a microscope indicating a very spherical shape of toner is obtained. The resulting toners can be selected for known electrophotographic imaging and printing processes to provide documents that provide the required MICR signal and the optical density of the characters.

The following Examples illustrate the embodiments and advantages of the present invention. Parts and percentages are by weight unless otherwise indicated.

EXAMPLES

Latex Formation Procedure

A latex emulsion (i) comprised of polymer particles generated from the emulsion polymerization of styrene, butyl acrylate and beta carboxy ethyl acrylate (Beta CEA) was prepared as follows. A surfactant solution of 434 grams of DOWFAX 2 A1™ (anionic emulsifier) and 387 kilograms of deionized water were prepared by mixing for 10 minutes in a stainless steel holding tank. The holding tank was then purged with nitrogen for 5 minutes before transferring the mixture into a reactor. The reactor was then continuously purged with nitrogen while being stirred at 100 RPM. The reactor was then heated to 80° C.

Separately, 6.11 kilograms of ammonium persulfate initiator were dissolved in 30.2 kilograms of deionized water. Also, separately a monomer emulsion A was prepared in the following manner. 315.7 Kilograms of styrene, 91.66 kilograms of butyl acrylate, 12.21 kilograms of β-CEA, 7.13 kilograms of 1-dodecanethiol, 1.42 kilograms of decanediol diacrylate (ADOD), 8.24 kilograms of DOWFAX™ (anionic surfactant), and 193 kilograms of deionized water were mixed to form an emulsion. Five percent of the above emulsion was then slowly fed into the reactor containing the aqueous surfactant phase at 80° C. to form seeds, wherein "seeds" refer, for example, to the initial emulsion latex added to the reactor, prior to the addition of the initiator solution while being purged with nitrogen. The above initiator solution was then slowly charged into the reactor forming about 5 to about 12 nanometers of latex "seed" particles. After 10 minutes, the remainder of the emulsion was continuously fed in using metering pumps.

After all of the above was charged into the main reactor, the temperature was maintained at 80° C. for an additional 2 hours to complete the reaction. The reactor contents were then cooled down to about 25° C. The resulting isolated product was comprised of 40 weight percent of submicron, 0.5 micron volume average diameter, and resin particles of styrene/butylacrylate/βCEA suspended in an aqueous phase containing the above surfactant. The molecular properties resulting for the resin latex throughout were $M_w$ of 39,000, $M_n$ of 10,800, as measured by a Gel Permeation Chromatograph, and a midpoint Tg of 55.8° C., as measured by a Differential Scanning Calorimeter, where the midpoint Tg is defined as the halfway point between the onset and the offset Tg of the polymer.

Wax and Pigment Dispersions

The aqueous wax dispersion utilized in these Examples was generated using P725 polyethylene wax of a weight average molecular weight of 725 and a melting point of 104° C., or a P 850 wax with molecular weight $M_w$ of 850 and a melting point of 107° C.; NEOGEN RK™ was selected as the anionic surfactant/dispersant. The waxes were available from Baker-Petrolite. The wax particle size was determined to be approximately 200 nanometers and the wax slurry was supplied with a solid loading of about 28 to about 30 percent.

The pigment dispersion utilized was an aqueous dispersion of carbon black (REGAL 330®) pigment supplied by Sun Chemicals. This pigment dispersion contained an anionic surfactant and the pigment content of the dispersion as supplied was 18 percent.

Example I

30 Percent Acicular Magnetite with P725 Wax:

5 Grams of acicular or needle shape. black magnetite (B2550) composed of 21 percent Fe and 79 percent $Fe_2O_3$ having a particle size of 0.6 micron in length and 0.1 micron in diameter were dispersed in 300 grams of water to which 1.2 grams of a 20 percent aqueous anionic surfactant (NEOGEN RK™) were added and ball milled for a period of 2 hours. The magnetite dispersion was transferred into a reaction kettle to which 80 grams of an 18 percent carbon black anionic dispersion were added. The resulting pigment dispersion was then aggregated with 330 grams of anionic latex comprised of submicron latex particles (40 percent solids) of styrene/butylacrylate/beta CEA, and 93 grams of 200 nanometers in size of submicron polyethylene P 725 wax particles, 68 percent water and 2 percent of an anionic surfactant dispersion, to which 300 grams of water were added to reduce the viscosity of the above mixture while being homogenized at a speed of 5,000 rpm. The resulting blend, with a pH measured of 2.6, was then heated to a temperature of 52° C. for a period of 480 minutes to obtain toner size aggregates of 6.2 microns with a GSD of 1.21 grams. 130 Grams of the above latex were then added to the aggregate mixture and left stirring overnight, about 18 to about 20 hours, at a temperature of 45° C., followed by changing the pH of the mixture to a pH of 7.3 with an aqueous solution of 4 percent sodium hydroxide. The mixture was then heated to 93° C. during which the pH was maintained between about 7 to about 7.3 with the addition of an aqueous 4 percent sodium hydroxide solution. After 3 hours at 93° C. the pH was reduced in stages (e.g. 6.5 to 5.5 to 5) with an aqueous 2.5 percent of nitric acid solution over a period of 1 hour. After a period of 5 hours at 93° C., the particle size measured was 6.6 microns with a GSD of 1.23. The mixture was allowed to coalesce further for a period of 11 hours resulting in a particle size of 6.7 microns with a GSD of 1.24. The resultant mixture was cooled and the toner obtained was washed 4 times with water and dried on a freeze dryer. The resulting toner was comprised of 29.5 percent magnetite, 57.5 percent resin, 4.5 percent carbon black, and 8.5 percent wax with a magnetite signal of 118 percent of nominal, a remanence of 26 emu/g, and wherein the toner particles were smooth with no or minimal protrusions.

Example II

30 Percent Magnetite with P850 Wax:

95 Grams of MAGNOX B2550™ acicular or needle shape magnetite composed of 21 percent FeO and 79 percent $Fe_2O_3$ having a particle size of 0.6 micron length×0.1 micron diameter were dispersed in 300 grams of water to which 1 gram of 20 percent aqueous. anionic surfactant (NEOGEN RK™) and 83 grams of 18 percent carbon black solution were added and ball milled for a period of 3 hours. The resulting pigment dispersion was then aggregated with 330 grams of an anionic latex comprised of submicron latex particles (40 percent solids) of styrene/butylacrylate/beta CEA, and 90 grams of 200 nanometers in size of polyethylene P850 wax particles (30 percent solids), 68 percent water and 2 percent anionic surfactant dispersion to which 300 grams of water were added to reduce the viscosity, while being homogenized at a speed of 5,000 rpm. The resulting blend with a pH of 2.6 was then heated to a temperature of 54° C. to obtain toner size aggregates of 5.8 microns for a period of 480 minutes. 130 Grams of the above latex were then added to the aggregate mixture and allowed to stabilize, followed by changing the pH of the mixture to a pH of 7 with an aqueous solution of 4 percent sodium hydroxide. The mixture was then heated to 93° C. during which the pH was maintained at 7 with the addition of aqueous 4 percent sodium hydroxide solution. After 2 hours at 93° C., the pH was reduced in stages (e.g. 6.5 to 5.5) with an aqueous 2.5 percent of nitric acid solution over a period of 1 hour. The mixture was allowed to heat for an additional period of 10 hours resulting in the morphology depicted. The toner was washed 4 times with water and dried on the freeze dryer. The toner provided a magnetic signal of 121 percent of nominal and the remanence measured was 26 emu/g, and wherein the toner particles were smooth with no observable protrusions.

Example III

20 Percent Acicular Magnetite and 20 Percent Cubic Magnetite:

65 Grams of acicular or needle shape black magnetite (B2550) composed of 21 percent Fe and 79 percent $Fe_2O_3$ having a particle size of 0.6 micron in length×0.1 micron in diameter, and 65 grams of cubic magnetite (MAPICO BLACK™) composed of 21 percent Fe and 79 percent $Fe_2O_3$ having a particle size of 0.1 micron in length×0.1 micron in width and 0.1 micron in height were dispersed in 500 grams of water to which were added 1.2 grams of a 20 percent aqueous anionic surfactant (NEOGEN RK™), followed by ball milling for a period of 2 hours. The magnetite dispersion was transferred into a reaction kettle to which 80 grams of 18 percent carbon black anionic dispersion were added. The resulting pigment dispersion was then aggregated with 280 grams of anionic. latex comprising submicron latex particles (40 percent solids) of styrene/butylacrylate/beta CEA, and 93 grams of 200 nanometers in a size of submicron polyethylene P 725 wax particles, 68 percent water and 2 percent anionic surfactant dispersion to which 300 grams of water were added to reduce the viscosity of the above mixture while being homogenized at speed of 5,000 rpm. The resulting blend whose pH measured was 2.5, was then heated to a temperature of 52° C. for a period of 200 minutes to obtain toner size aggregates of 6.3 microns with a GSD of 1.20 grams. 100 Grams of the above latex were then added to the aggregate mixture and left stirring overnight at a temperature of 45° C., followed by changing the pH of the mixture to a pH of 7.3 with an aqueous solution of 4 percent sodium hydroxide. The mixture was then heated to 93° C. during which the pH was maintained between about 7.2 to about 7.6 with the addition of an aqueous 4 percent sodium hydroxide solution. After 3 hours at 93° C., the pH was reduced in stages (e.g. 6.5 to 5.8) with an aqueous 2.5 percent of nitric acid solution over a period of 1 hour. After a period of 5 hours at 93° C., the particle size measured was 6.7 microns with a GSD of 1.23. The mixture was allowed to coalesce further for a period of 11 hours resulting in a particle size of 6.7 microns with a GSD of 1.24. The resultant mixture was cooled and the toner obtained was washed 4 times with water and dried on the freeze dryer. The resulting toner comprised of 40.4 percent magnetite, 47.2 percent resin, 4.3 percent carbon black, and 8.1 percent wax provided a magnetite signal of 98 percent of nominal. The particle morphology was smooth with no protrusions.

Example IV

30 Percent Acicular Magnetite with P725 Wax, No Carbon Black (CB):

90 Grams of acicular or needle shape black magnetite (B2550) composed of 21 percent Fe and 79 percent $Fe_2O_3$ having a particle size of 0.6 micron in length×0.1 micron in diameter were dispersed in 300 grams of water to which 1.2 grams of a 20 percent aqueous anionic surfactant (NEOGEN RK™) were added, followed by ball milling for a period of 2 hours. The magnetite dispersion was transferred into a reaction kettle. The resulting pigment dispersion was then aggregated with 330 grams of an anionic latex comprising submicron latex particles (40 percent solids) of styrene/butylacrylate/beta CEA, and 93 grams of 200 nanometers in size submicron polyethylene P725 wax particles, 68 percent water and 2 percent of the anionic surfactant dispersion to which 300 grams of water were added to reduce the viscosity of the above mixture while being homogenized at a speed of 5,000 rpm. The resulting blend, whose pH measured 2.6, was then heated to a temperature of 52° C. for a period of 480 minutes to obtain toner size aggregates of 6.2 microns with a GSD of 1.21 grams. 130 Grams of the above latex were then added to the aggregate mixture and left stirring overnight at a temperature of 45° C., followed by changing the pH of the mixture to a pH of 7.3 with an aqueous solution of 4 percent sodium hydroxide. The mixture was then heated to 93° C. during which the pH was maintained between about 7 to about 7.3 with the addition of an aqueous 4 percent sodium hydroxide solution. After 3 hours at 93° C., the pH was reduced in stages (e.g. 6.5 to 5.5 to 5) with an aqueous 2.5 percent of nitric acid solution over a period of 1 hour. After a period of 5 hours at 93° C., the particle size measured was 6.6 microns with a GSD of 1.23. The mixture was allowed to coalesce further for a period of 11 hours resulting in a particle size of 6.7 microns with a GSD of 1.24. The resultant mixture was cooled and the toner obtained was washed 4 times with water and dried on the freeze dryer. The resulting toner was comprised of 30 percent magnetite, 61.3 percent resin, and 8.7 percent wax. The toner prepared provided a MICR signal of 121 percent of the nominal. The lack of carbon black resulted in the toner having a reddish color.

The magnetic signal is a measure of the standard calibration document as defined by the Banker's Association Standard and Specifications for MICR Encoded Document. Generally, each country sets a minimum percent signal level, for example the minimum signal level in the USA is 50 percent of the nominal, while in Canada it is 80 percent of the nominal. To ensure latitude in the printing process, it is generally desirable to exceed the nominal specification, for example the target signal which is about 115 to about 130 percent of the nominal to minimize the document rejection rates.

Other embodiments and modifications of the present invention may occur to those skilled in the art subsequent to a review of the information presented herein; these embodiments and modifications, equivalents thereof, substantial equivalents thereof, or similar equivalents thereof are also included within the scope of this invention.

What is claimed is:

1. A process for the preparation of a magnetic toner comprising heating a colorant acicular magnetite dispersion, a carbon black dispersion, a latex emulsion, and a wax dispersion.

2. A process in accordance with claim 1 wherein said magnetite dispersion contains an anionic surfactant and a nonionic surfactant when said dispersion possesses a pH of from about 6.5 to about 6.8.

3. A process in accordance with claim 1 wherein said carbon black comprises particles dispersed in water and an anionic surfactant, and which dispersion possesses a pH of about 6.3 to about 6.8.

4. A process in accordance with claim 1 wherein said acicular magnetite is present in an amount of from about 20 to about 35 percent by weight of toner, and wherein in the presence of an acidic anionic latex said magnetite is charged thereby facilitating aggregation.

5. A process in accordance with claim 1 wherein said acicular magnetite is present in an amount of from about 23 to about 32 percent by weight of toner, and wherein in the presence of an acidic anionic latex functions as positively charged particles thereby facilitating aggregation.

6. A process in accordance with claim 1 wherein said acicular magnetite utilized exhibits a coercivity of from about 250 to about 700 Oe.

7. A process in accordance with claim 1 wherein said acicular magnetite has a particle size of about 0.6 micron in length by 0.1 micron in diameter, and is comprised of about 21 percent FeO and about 79 percent $Fe_2O_3$.

8. A process in accordance with claim 1 wherein said toner exhibits a magnetic signal of from about 115 to about 150 percent of the nominal signal.

9. A process in accordance with claim 1 wherein said toner possesses a minimum fix temperature (MFT) of about 170° C. to about 195° C.

10. A process in accordance with claim 9 wherein the toner hot offset temperature (HOT) is in excess of about 210° C.

11. A process in accordance with claim 1 wherein the magnetite dispersion is obtained by a ball milling, attrition, polytroning or media milling resulting in magnetite particles dispersed in water containing an anionic surfactant.

12. A process in accordance with claim 1 wherein the carbon black dispersion is present in an amount of about 4 to about 8 percent by weight of toner.

13. A process in accordance with claim 1 wherein the latex resin particles are from about 0.15 to about 0.3 micron in volume average diameter.

14. A process in accordance with claim 1 wherein said magnetite is of a size of about 0.6 micron to about 0.1 micron, and said carbon black is of a size of about 0.01 to about 0.2 micron in average volume diameter.

15. A process in accordance with claim 1 wherein the said acid is selected from the group consisting of nitric, sulfuric, hydrochloric, citric and acetic acid.

16. A process in accordance with claim 1 wherein said base is selected from the group consisting of sodium hydroxide, potassium hydroxide, and ammonium hydroxide.

17. A process in accordance with claim 1 wherein there is added to the formed toner aggregates a second latex comprised of submicron resin particles suspended in an aqueous phase containing an anionic surfactant, and wherein said second latex is selected in an amount of from about 10 to about 40 percent by weight of the initial latex to form a shell thereover on said formed aggregates, and which shell is of a thickness of about 0.2 to about 0.8 micron.

18. A process in accordance with claim 17 wherein the added latex contains the same resin as the initial latex of (i), or wherein said added latex contains a dissimilar resin than that of the initial latex.

19. A process in accordance with claim 1 (v) wherein the pH of the mixture resulting in (vi) is increased from about 2 to about 2.6 to about 6.5 to about 7.2, and wherein said base functions primarily as a stabilizer for the aggregates during coalescence (vii), and no or minimal toner particle size or GSD increases result.

20. A process in accordance with claim 1 wherein the temperature at which toner sized aggregates are formed controls the size of the aggregates, and wherein the final toner size is from about 5 to about 12 microns in volume average diameter.

21. A process in accordance with claim 1 wherein the aggregation (iv) temperature is from about 45° C. to about 60° C., and wherein the coalescence or fusion temperature of (vii) and (viii) is from about 85° C. to about 95° C.

22. A process in accordance with claim 1 wherein the time of coalescence or fusion is from about 12 to about 20 hours, and wherein thereon are provided toner particles with a smooth morphology.

23. A process in accordance with claim 1 wherein the latex contains a resin or polymer selected from the group consisting of poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid).

24. A process in accordance with claim 1 wherein the latex contains a resin selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly (propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic. acid), poly(styrene-butyl acrylate-acrylononitrile), and poly (styrene-butyl acrylate-acrylononitrile-acrylic acid).

25. A process in accordance with claim 1 wherein said magnetite functions as a positively charged coagulant.

26. A process for the preparation of a magnetic toner comprising heating a colorant dispersion containing acicular magnetite, a carbon black dispersion, a latex emulsion, and a wax dispersion, and wherein said heating comprises a first heating at a temperature below the latex resin Tg, and a second heating above the latex resin Tg.

27. A process for the preparation of a magnetic toner comprising heating a colorant dispersion containing acicular magnetite, a carbon black dispersion, and a latex emulsion, and wherein said heating comprises a first heating at a temperature below the latex resin Tg, and a second heating above the latex resin Tg.

28. A process for the preparation of a magnetic toner comprising heating an acicular magnetite dispersion, a carbon black dispersion, a latex emulsion, and a wax dispersion, and wherein (i) said acicular magnetite dispersion contains water and an anionic surfactant, or a nonionic surfactant, and said dispersion of carbon black contains water and an anionic surfactant, or a nonionic surfactant; and wherein said carbon black dispersion possesses a pH of about 6.3 to about 6.8, and wherein said latex is an emulsion comprised of an anionic surfactant, water and resin, and which emulsion is at a pH of about 1.5 to about 2.5;

(ii) wherein said colorant dispersion is blended with said latex emulsion, and thereafter adding a wax dispersion comprised of submicron wax particles of from about 0.1 to about 0.5 micron in diameter by volume, and which wax is dispersed in an anionic surfactant;

(iii) wherein the resulting blend possesses a pH of about 2.2 to about 2.8 thereby inducing a positive charge on the magnetite particles to thereby initiate flocculation or aggregation of said resin latex, said colorant, and said wax;

(iv) heating the resulting mixture below about the glass transition temperature (Tg) of the latex resin to form toner sized aggregates;

(v) adding to the formed toner aggregates a second latex comprised of resin suspended in an aqueous phase containing an ionic surfactant and water, and stirring for a period of time to permit stabilization of aggregate particle size;

(vi) adding to the resulting mixture a base to thereby change the pH, which is initially from about 2 to about 2.8, to arrive at a pH of from about 6.9 to about 7.3 for the resulting toner aggregate mixture;

(vii) heating the resulting aggregate suspension of (vi) above about the Tg of the latex resin of (i), while maintaining the pH at a value of about 6.9 to about 7.3;

(viii) retaining the mixture temperature at from about 85° C. to about 95° C. for an optional period of about 10 to about 60 minutes, followed by a pH reduction with an acid to arrive at a pH of about 5.3 to about 5.8;

(ix) retaining the mixture temperature at from about 85° C. to about 95° C. for a period of about 7 to about 14 hours to assist in permitting the fusion or coalescence of the toner aggregates and to obtain smooth particles;

(x) washing the resulting toner slurry; and (xi) isolating the toner.

* * * * *